US005437371A

United States Patent [19]

Lataix

[11] Patent Number: 5,437,371

[45] Date of Patent: Aug. 1, 1995

[54] CHILD RESISTANT BLISTER PACKAGE

[75] Inventor: Gilbert Lataix, Clermont-Ferrand, France

[73] Assignee: Merck & Co., Inc., Rahway, N.J.

[21] Appl. No.: 241,239

[22] Filed: May 10, 1994

[51] Int. Cl.[6] ..... B65D 83/04

[52] U.S. Cl. ..... 206/539; 206/538; 206/467; 206/468; 220/346

[58] Field of Search ..... 206/539, 464, 467, 468, 206/538; 383/69; 220/346

[56] References Cited

U.S. PATENT DOCUMENTS 4,120,400 10/1978 Kotyuk ..... 220/346
5,080,222 1/1992 McNary ..... 220/346
5,082,137 1/1992 Weinstein ..... 220/346
5,129,527 7/1992 Lataix ..... 206/539

*Primary Examiner*—Paul T. Sewell
*Assistant Examiner*—Tara Laster
*Attorney, Agent, or Firm*—Hesna J. Pfeiffer; Mark R. Daniel

[57] ABSTRACT

There is disclosed a child resistant blister package comprising a conventional blister package having cavities containing unit doses of medication. The blister package is adapted to receive a locking member which is slidably secured to the blister package to effectively prevent children from accessing the medication therein and yet is readily, slidably removed from the blister package by an adult to access medication therefrom.

4 Claims, 5 Drawing Sheets

CHILD RESISTANT BLISTER PACKAGE

BACKGROUND OF THE INVENTION

This invention is directed toward a child resistant blister package of the type commonly used to package multiple units of medication in tablet or pill form. Such blister packages typically comprise a plastic laminate film having a plurality of cavities formed therein in which units of medication in pill or tablet form are placed and an aluminum cover sheet which overlies the cavities and is adapted to be sealed to the plastic laminate. To remove a pill or tablet, one manually pushes the pill or tablet through the aluminum cover sheet. In other types of commercial blister packages, the aluminum cover sheet is adapted to be peelably sealed to the plastic laminate so that a pill or tablet can be accessed by peeling the aluminum cover sheet off of the plastic laminate.

Due to the relative ease with which the cover sheet of these commercial blister packages can be peeled off or punctured, their medication contents can be readily accessed by children who, imitating their elders, can accidentially ingest medication that may be harmful to them.

SUMMARY OF THE INVENTION

It has now been found that these commercial blister packages can be made to be effectively child resistant by the child resistant blister package of this invention.

The child resistant blister package of the invention generally comprises a typical blister package adapted to receive a locking member which can readily be slidably secured to and slidably removed from the blister package. When secured to the blister package, the locking member prevents access to the unit doses of medication but upon being slidably removed, the medication is readily accessible.

In summary, the child resistant blister package of the invention comprises a blister package having a plurality of cavities containing units of medication in pill or tablet form. The blister package is adapted to have opposed, extended sides in which are formed at least one notch in each side. Adjacent to and inboard from the notch on each side is a fib member which is parallel to and substantially the same length as the extended sides. Preferably, a second rib member is also provided parallel to and spaced inwardly from the first rib member to prevent the locking member from being grasped easily by a child. The height of the second rib member is about the height of the cavities containing the trait doses of medication while the height of the rib member is about half that of the second rib member.

The locking member for the blister package is generally rectangularly shaped as is preferably fabricated or molded from a suitable plastic material such as polypropylene to facilitate its ability to be slidably secured to and slidably removed from the blister package. Thus, the generally rectangular locking member has opposed top and bottom walls, opposed inner and outer side wails and opposed end walls.

In a preferred embodiment of this invention, two T-shaped key slots are formed in the inner side wall and the outer side wall, and extend through the body and the opposed end walls of the locking member. An open channel is provided in the both side walls at the head of each T-shaped key slot forming opposed upward and downward extensions. Each channel extends the length of the locking member and communicates with the head of its respective T-shaped key slot. The leg of each T-shaped key slot defines a groove which extends through the length of the locking member and which also communicates with the head of the T-shaped key slot.

In the area of the locking member between the two T-shaped key slots, there are at least two rectangular-shaped flexible locks which block a portion of the extended groove formed by the leg of each T-shaped key slot. The rectangular locks are positioned so that their outwardly projecting flanges are aligned with and engage the notches formed in the extended sides of the blister package. This enables the locking member to be manually flexed to disengage the outwardly projecting flanges from the notches in the extended sides of the blister package permitting the locking member to be slidably removed from the blister package.

In assembly, the blister package is folded so that the two notches and the rib members in its extended sides are respectively in superimposed alignment with each other. The locking member is then slidably secured to the superimposed, extended sides of the blister package so that the outermost rib member is received by and contained within the head of the T-shaped key slot; the superimposed, extended sides of the blister package inboard of the outer rib member are received by and contained within the open channel by impingement by and between the upward and downward extensions; and, the outwardly projecting flexible flanges of the lock are mated with and engage the notches.

To assemble the locking member to the blister package in this manner, the blister package has chamfered edges, which push on the flexible locks, forcing the locks to retract without flexing the locking member. The chamfered edges of the superimposed extended sides of the blister package enable the locking member to be slidably secured to the blister package as described above.

To remove the locking member from the blister package and access the units of medication, the locking member is flexed to disengage the inwardly projecting flanges from the notches enabling the locking member to be slidably removed.

DETAILED DESCRIPTION OF THE INVENTION

The child resistant blister package of the invention will become more apparent from the ensuing description when considered together with the accompanying drawing wherein like reference numerals denote like parts and wherein.

Figure 2:
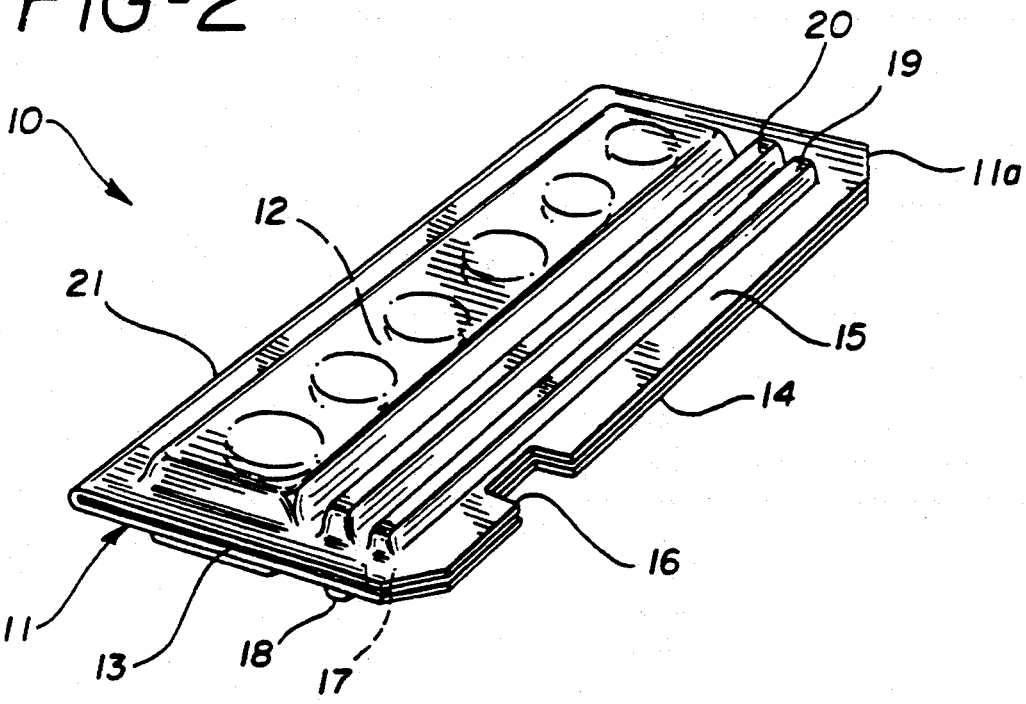
FIG. 2 is a perspective view of the blister package of FIG. 1 after it has been folded and is ready to receive the locking member.
Figure 3:
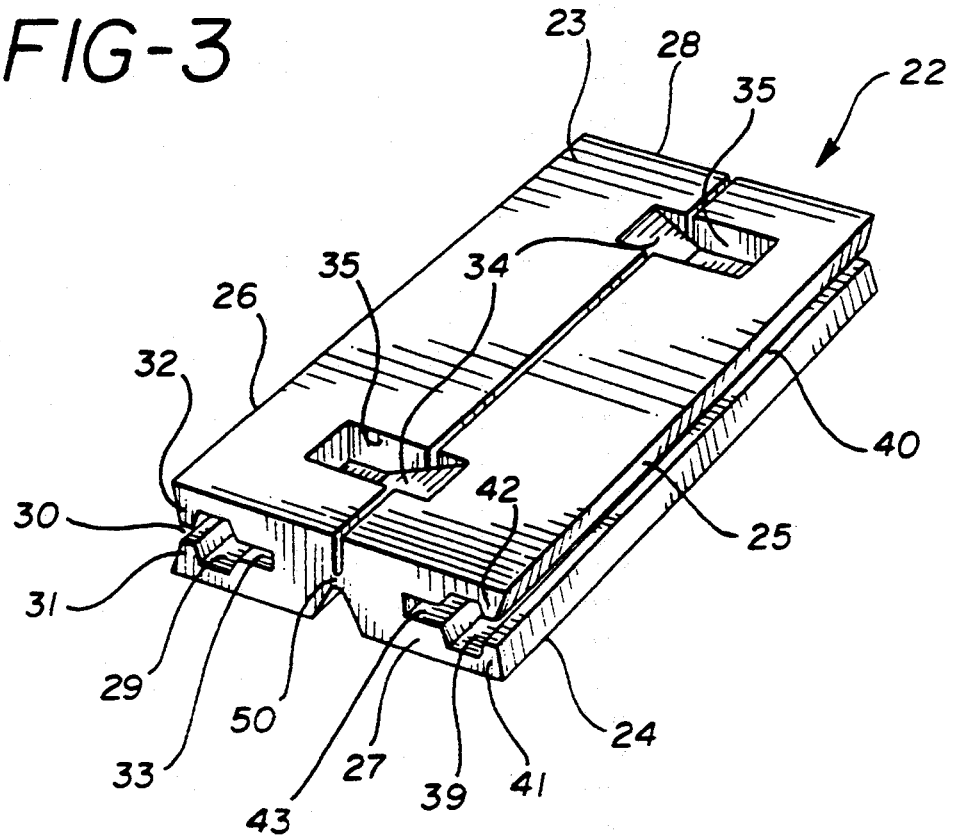
FIG. 3 is a perspective view of the locking member for the blister package.
Figure 4A:
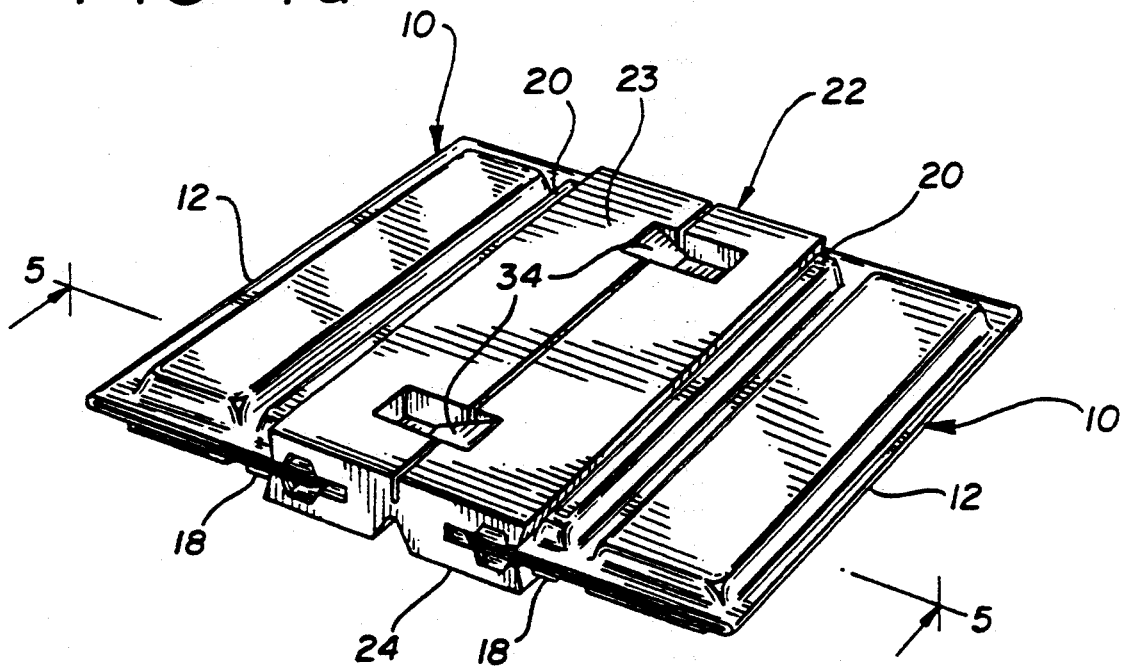
Figure 4B:
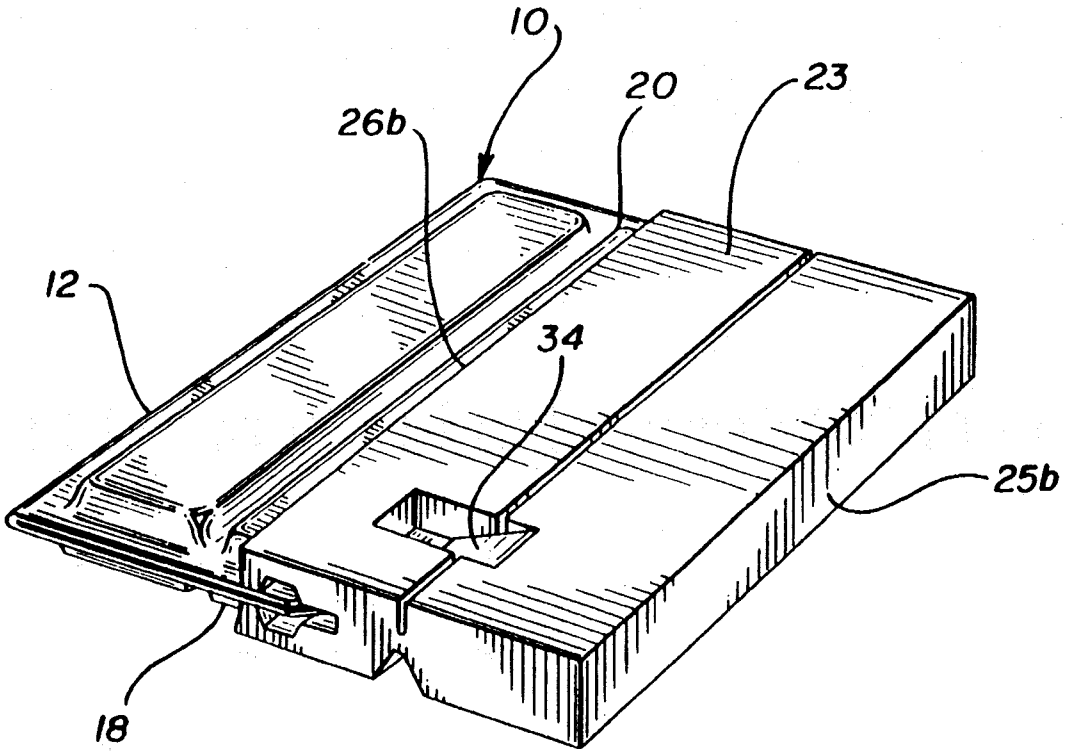
Figure 5:
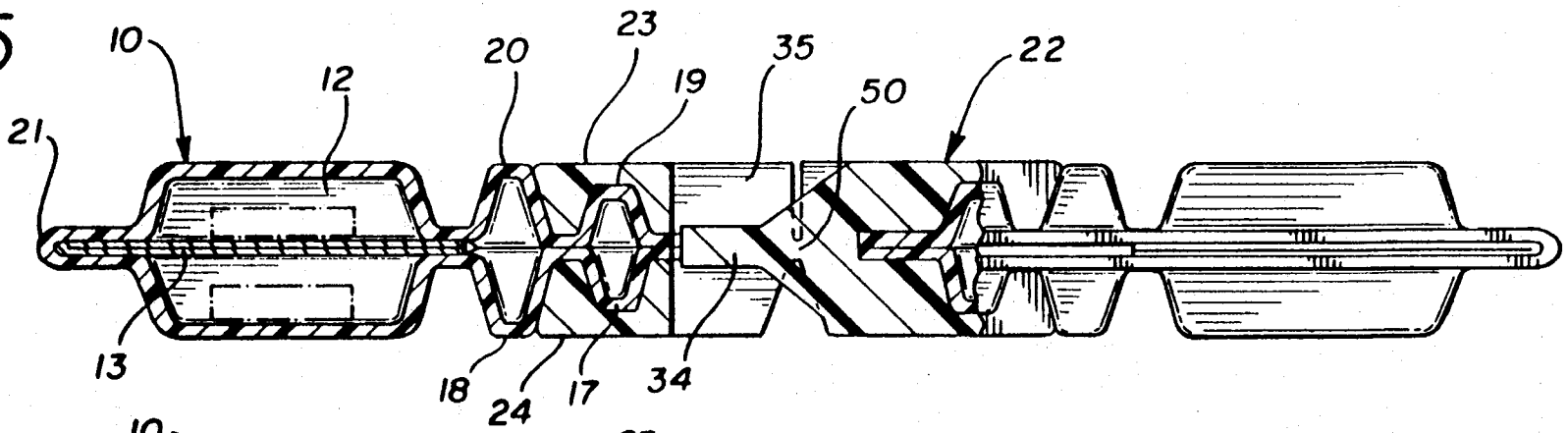
Figure 6:
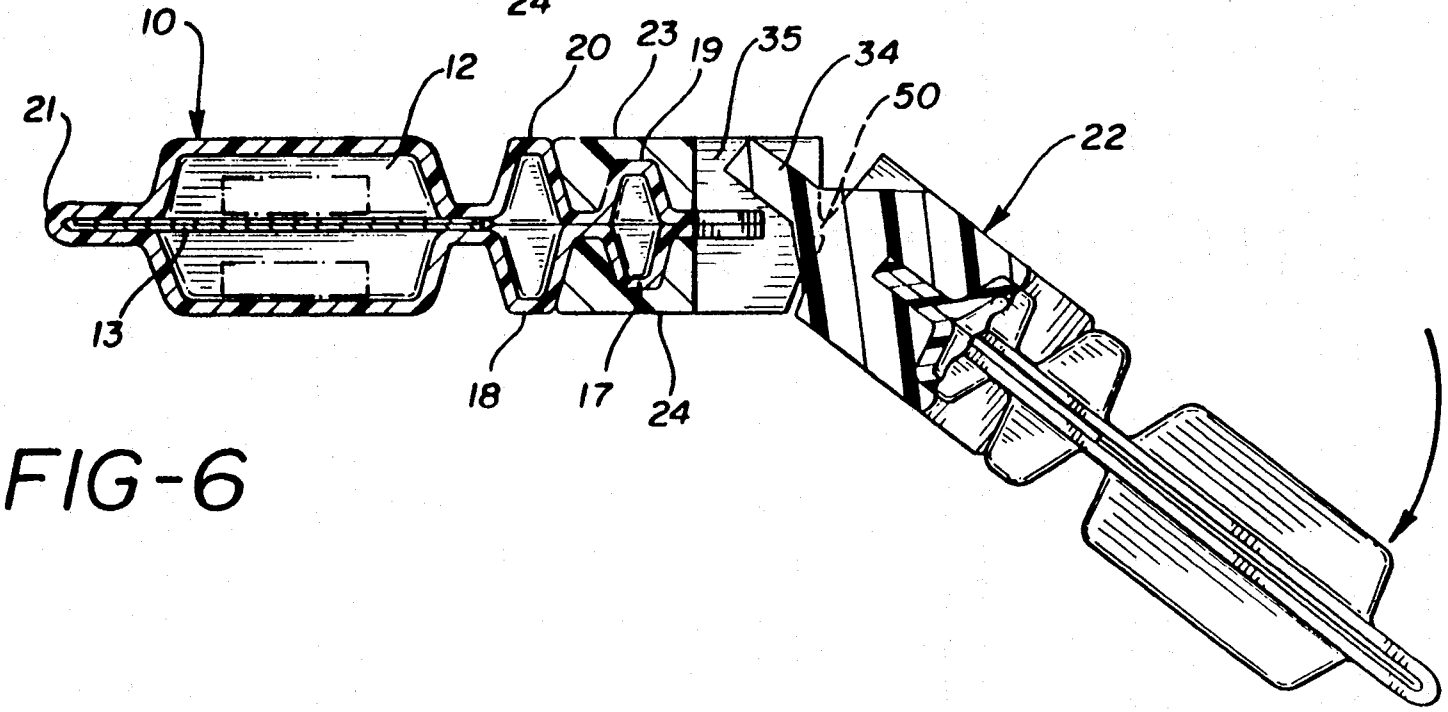
Figure 7:
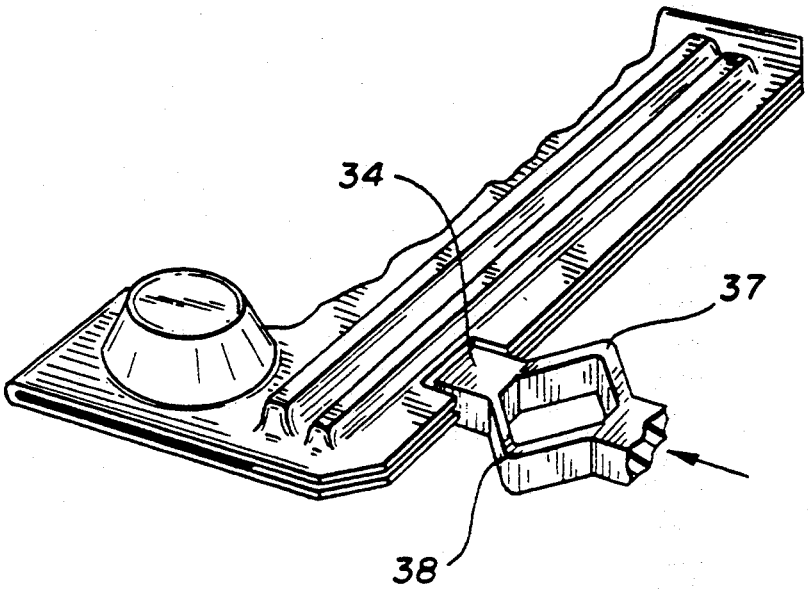
Figure 8:
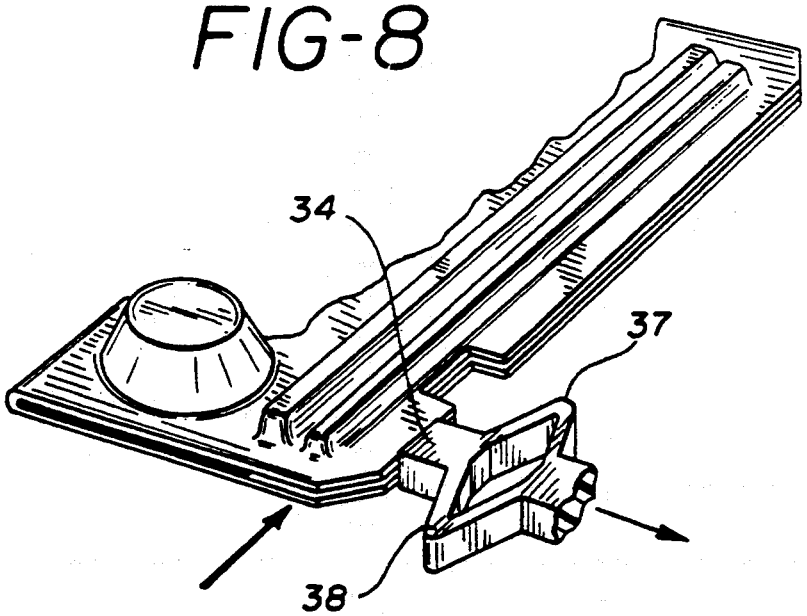

FIG. 4*a* is a perspective view showing two blister packages of FIG. 2 and the locking member of FIG. 3 when assembled; FIG. 4*b* is a perspective view of a single blister with a modified locking member;

FIG. 5 is an exaggerated view taken substantially on the line 5—5 of FIG. 4 showing a lock and release tab in a locked position;

FIG. 6 is a view similar to that of FIG. 5 showing the flexed, unlocked position of a lock and release tab; FIGS. 7 and 8 are partial perspective views of the locked and flexed, unlocked positions, respectfully.

Figure 1:
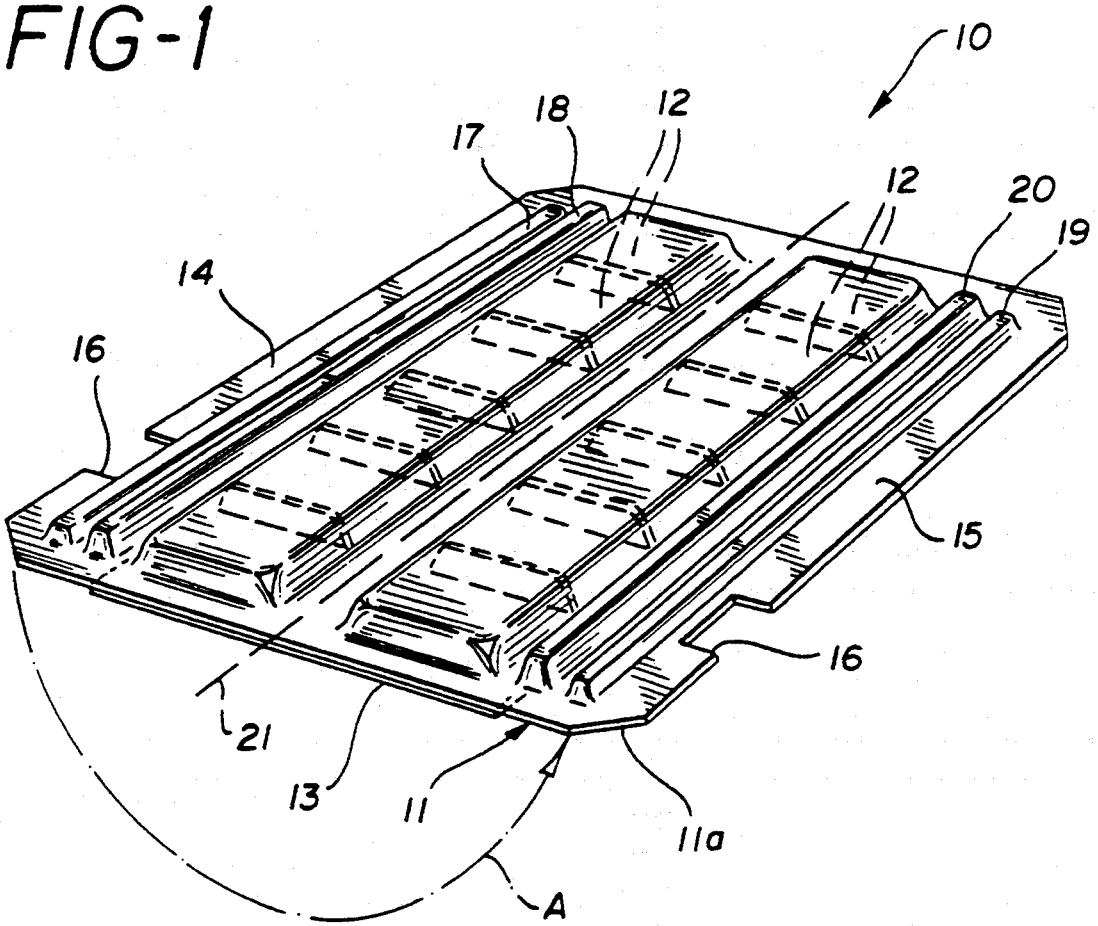
FIG. 1 is a perspective view of the child resistant blister package of the invention.

As shown in FIG. 1, a conventional blister package, generally identified by reference numeral 10, typically comprises a plastic laminate film 11 in which a plurality of cavities 12 have been formed to contain units of medication in pill or tablet form (not shown). An aluminum cover sheet 13 overlies the cavities 12 and is bonded to the plastic laminate film 11 to complete the blister package. The comers of the film 11 are chamfered as shown at 11*a*.

To provide the child resistant blister package of the invention, the blister package 10 is adapted to have opposed, extended sides 14, 15, each of which has a notch 16 formed along their edges. Spaced inwardly from notch 16 on each side 14, 15 are a pair of upwardly extending parallel ribs 17, 18 and 19, 20, respectively, which are substantially coextensive with the length of extended sides 14, 15. Outboard ribs 17 and 19 are fabricated to be about half the height of inboard ribs 18 and 20 and sized to be closely received within the head of the T-shaped key slot of the locking member as described in more detail hereinbelow.

To receive the locking member of the invention, blister package 10 is folded along its mid-longitudinal axis, indicated in dashed lines by reference numeral 21, in the direction of arrow A as shown in FIG. 1 so that extended side 15 overlays and is superimposed upon extended side 14 with notch 16 in superimposed, common alignment and ribs 17, 19 and 18, 20, respectively, in substantial vertical alignment with one another as can be seen in FIGS. 2 and 4. Thus, mid-longitudinal axis 21 serves as a hinge area when superimposing and overlaying the extended sides on one another. Alternatively, two blister packages 10 can be superimposed upon one another (not shown) with their extended sides overlying one another and their notches in common alignment.

As shown in FIG. 3, the locking member of the invention, identified by reference numeral 22, is generally rectangular and has opposed top and bottom walls 23, 24, opposed side walls 25, 26 and opposed end walls 27, 28. Extending through the body as well as end walls 27, 28 of locking member 22 are preferably two T-shaped key slots 29 and 39. Open channels 30 and 40 are provided in side walls 25, 26 that extend the length of locking member 22 communicating with the heads of T-shaped key slots 29, 39 and forming opposed upward and downward extensions 31, 32 and 41, 42. The legs of T-shaped key slots 29 and 39 adjacent side walls 25 and 26 define grooves 33, 43 which also extend throughout locking member 22 and communicates with the heads of T-shaped key slots 29, 39.

As illustrated in FIGS. 3 and 4, the locking member 22 is provided with two locks, generally identified by reference numeral 34, which are positioned in the middle of the locking member 22 (FIG. 3). These locks 34 are fitted within retangular openings 35 in the locking member 22 (FIG. 3) in mating relationship.

When this preferred embodiment is assembled, two blister packages 10 and the locking member 22 appear as depicted in FIG. 4 with extensions 31, 41 and 32, 42 impinging upon and securing therebetween extended sides 14, 15 in the area defined between inner ribs 18, 20 and outer ribs 17, 19 to closely contain outer ribs 17, 19 within the heads of T-shaped key slots 29, 39 and with inwardly projecting flanges 37, 38 of locks 34 tabs in mating, locking engagement with notches 16 as shown in FIGS. 5 and 7. This interfitting relationship coupled with the relatively greater height of inner ribs 18, 20 prevents the locking member 22 from being removed from the blister package 10 by a child.

To remove the locking member 22 from one blister package 10, the locking member 22 is manually flexed at 50 to disengage the inwardly projecting flanges 37, 38 from notches 16 as illustrated in FIGS. 6 and 8. The locking member 22 can then be removed from the blister package 10 by sliding it longitudinally along ribs 18, 20 and 17, 19 until it is completely disengaged. The blister package can then be unfolded and medication removed therefrom in the usual manner.

Reassembly of the blister package 10 and the locking member 22 is accomplished by pushing blister package 10 into the locking member 22, so that extended sides 14, 15 are slidably received between extensions 31, 32 while pushing flanges 37, 38 to retract. The blister package 10 is then re-positioned between inner ribs 18, 20 and outer ribs 17, 19 with outer ribs 17, 19 closely contained within the head of T-shaped key slot 29 and inwardly projecting flanges 37, 38 in locking engagement with notches 16. Inner ribs 18, 20 also serve as guide means as the locking member 22 is being slideably secured to the blister package 10 during reassembly.

While the child resistant blister package of the invention has been described with particularity and in some detail, it should be understood and will be apparent to those skilled in the art that variations and modifications can be made therein without departing from the scope of the invention recited in the claims. One variation in particular is the locking member adapted to hold only one blister pack; instead of two T-shaped key slots, only one in one side wall would be provided, and the other side wall would be planar. An example is shown in FIG. 4*b* showing planar side wall 25*b* opposite to the other side wall 26*b* having the slots and grooves in it. It would be desirable, but not critical, to still have two locks, but also on the same side, thereby also necessitating a pail of notches on the opposed side of the blister package.

What is claimed is:

1. A child resistant blister package comprising:

(i) a blister package formed from a film having a plurality of cavities formed therein in which units of medication are placed and a cover sheet which overlies said cavities and which is bonded to said film, said blister package adapted to have:

(a) opposed, extended sides which are chamfered on the corners;

(b) at least one notch formed in each said opposed, extended sides;

(c) a pair of raised, parallel rib members provided on and substantially co-extensive with each of said opposed, extended sides, said pairs of rib members being positioned inboard of said notches and spaced from each other;

(d) means to overlay said opposed, extended sides such that said pairs of parallel ribs and said notches are in vertical superimposed alignment with each other; and, (ii) a generally rectangular locking member having opposed top and bottom walls, opposed side walls and opposed end walls, said locking member having:

(a) at least one T-shaped key slot formed within said locking member and extending through said opposed end walls;

(b) a channel formed in a side wall of said locking member communicating with the head of said T-shaped key slot and defining opposed upward and downward extensions capable of receiving and impinging therebetween the overlaid, opposed extended sides of said blister package, the head of said T-shaped key slot capable of receiving therein in close fitting relationship the outermost superimposed and aligned rib members;

(c) at least one rectangular-shaped flexible lock between the T-shaped key slot which blocks a portion of the extended groove formed by the leg of said T-shaped key slot, said lock being positioned so that its outwardly projecting flange is aligned with and engages the notch formed in the opposed extended sides of the blister package;

such that manual flexing of said locking member permits said locking member to be slidably removed from or mounted on said blister package and, when mounted on said blister package, release of said manual flexing permits said outwardly projecting flanges to impinge therebetween the notch formed in overlaid, opposed extended sides of said blister package.

2. The blister package of claim 1 in which 1 or 2 notch(es) is (one) in each opposed extended side of the package.

3. The blister package of claim 1 in which there is 1 notch in each side.

4. The blister package of claim 3 in which there are two rectangular-shaped flexible locks in the locking member.

* * * * *